US012540527B1

(12) United States Patent
Marhoon et al.

(10) Patent No.: US 12,540,527 B1
(45) Date of Patent: Feb. 3, 2026

(54) METHODS FOR SEALING LEAKS IN OIL AND GAS WELLS

(71) Applicants: Saudi Arabian Oil Company, Dhahran (SA); Wellbore Integrity Solutions, Damman (SA)

(72) Inventors: Zahrah Marhoon, Saihat (SA); Amjad Alshaarawi, Khobar (SA); Abdallah A. Kubaisi, Udhailiyah (SA); Jafar S. Alzaid, Al Ahsa (SA); David Shearer, West Midlands (GB); Shantanu Swadi, Houston, TX (US)

(73) Assignees: Saudi Arabian Oil Company, Dhahran (SA); Wellbore Integrity Solutions, Damman (SA)

( * ) Notice: Subject to any disclaimer, the term of this patent is extended or adjusted under 35 U.S.C. 154(b) by 0 days.

(21) Appl. No.: 19/039,078

(22) Filed: Jan. 28, 2025

(51) Int. Cl.
*E21B 33/138* (2006.01)
*E21B 29/00* (2006.01)
*E21B 33/12* (2006.01)

(52) U.S. Cl.
CPC ..... *E21B 33/138* (2013.01); *E21B 29/002* (2013.01); *E21B 33/12* (2013.01); *E21B 33/1208* (2013.01)

(58) Field of Classification Search
None
See application file for complete search history.

(56) References Cited

U.S. PATENT DOCUMENTS

| | | | | |
|---|---|---|---|---|
| 6,384,389 | B1 * | 5/2002 | Spencer | E21B 33/138 166/60 |
| 2009/0183884 | A1 * | 7/2009 | Hansen | E21B 29/10 166/387 |
| 2016/0168971 | A1 | 6/2016 | Wood et al. | |
| 2018/0100373 | A1 * | 4/2018 | Krüger | E21B 29/002 |
| 2018/0298715 | A1 * | 10/2018 | Shafer | E21B 33/13 |
| 2023/0313637 | A1 * | 10/2023 | Head | E21B 33/1208 166/285 |
| 2024/0191594 | A1 | 6/2024 | Arceneaux et al. | |
| 2025/0052129 | A1 * | 2/2025 | Vasques | E21B 33/13 |

* cited by examiner

*Primary Examiner* — Andrew Sue-Ako
(74) *Attorney, Agent, or Firm* — Fish & Richardson P.C.

(57) ABSTRACT

A method of sealing leaks in oil and gas wells includes: removing a portion of an inner casing string within a wellbore to access an annulus associated with an area of fluid leakage; filling a first portion of the annulus with a first metal alloy to form a first metal alloy layer; filling a second portion of the annulus with cement to form a cement layer over the first metal alloy layer; and filling a third portion of the annulus with a second metal alloy to form a second metal alloy layer over the cement layer. The first metal alloy layer, the cement layer, and the second metal alloy layer together seal the annulus.

20 Claims, 6 Drawing Sheets

METHODS FOR SEALING LEAKS IN OIL AND GAS WELLS

TECHNICAL FIELD

This description generally relates to methods for sealing leaks in oil and gas wells.

BACKGROUND

In oil and gas wells, leakage, including fluid and pressure leakage, can occur due to various factors. When such leakage arises, a cement job is often performed to seal leaks in the annulus or between the casings within the well. One objective of this cementing operation is to achieve zonal isolation to prevent downhole fluids from migrating to the surface within the annulus or between the casing strings. This isolation is associated with well integrity and safe operation of the well.

SUMMARY

This disclosure describes technologies relating to methods for sealing leaks in oil and gas wells.

The details of one or more embodiments of the subject matter of this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Figure 1C:
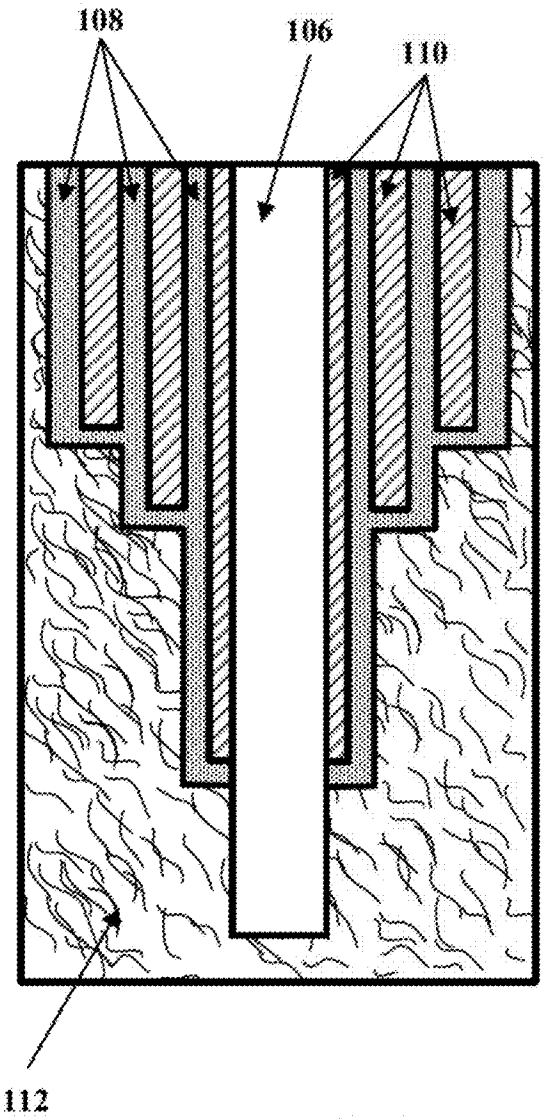
FIGS. 1A-1C are diagrams illustrating an example of drilling oil and gas wells and forming casings.
Figure 1B:
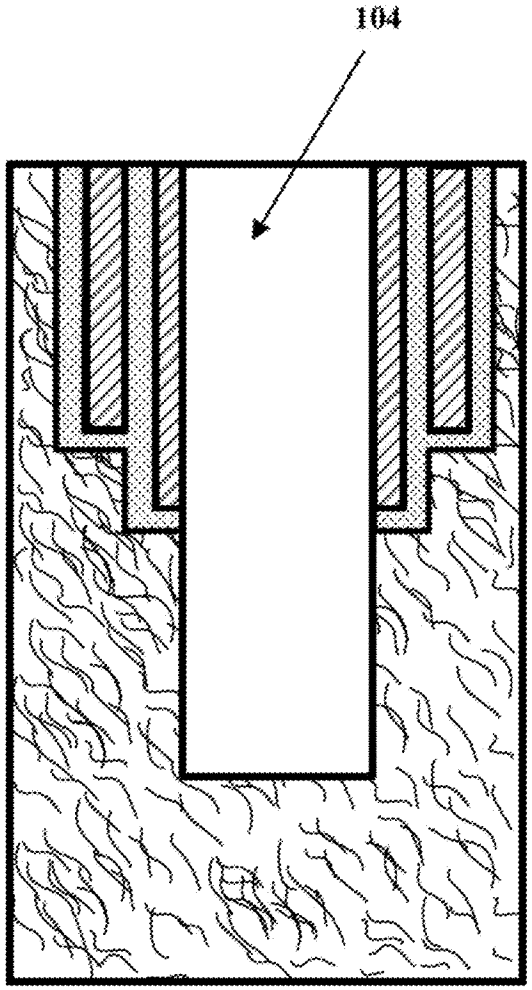
Figure 1A:
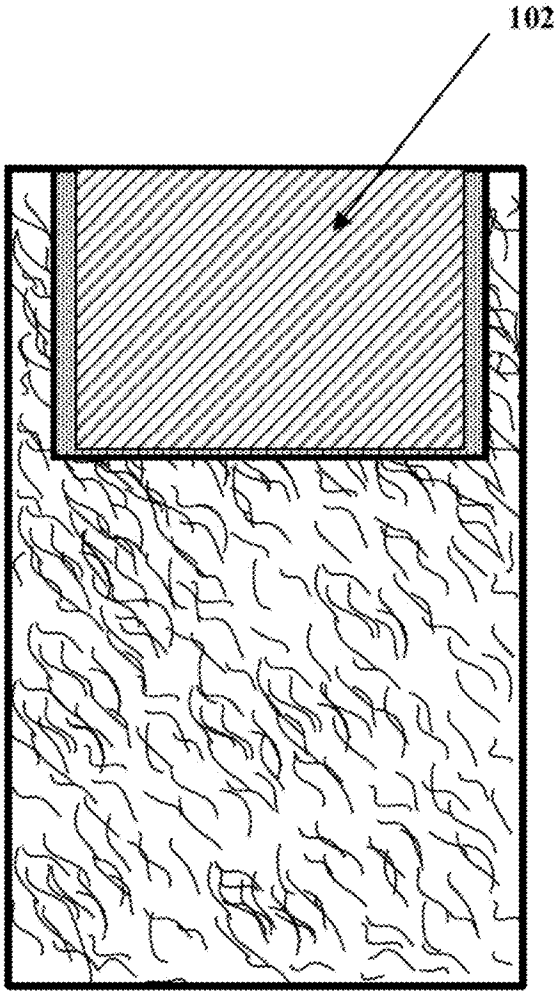

In the drilling industry, the process of drilling oil and gas wells can be executed in multiple stages, with each stage corresponding to a specific locational section of the wellbore. The process can begin by drilling the first section of the well with a large initial diameter. Upon reaching a certain depth, the drilling assembly can be removed and a casing string can be set and cemented in place (e.g., in the hole drilled at the well). Subsequently, the next section can be drilled with a slightly smaller diameter to ensure that the drilling assembly can pass through the inner diameter of the previously cemented casing string. The process can be continued until the total well depth is reached as illustrated in FIGS. 1A-1C. FIG. 1A illustrates a first section 102 that is drilled, FIG. 1B illustrates a second section 104 that has smaller diameter than the first section 102, and FIG. 1C illustrates a third section 106 that has smaller diameter than the first section 102 and the second section 104. Further, each of the FIGS. 1A-1C illustrate cemented annulus 108, casings 110, and rock formation 112.

As described above, during the operation of oil and gas wells, leakage (including fluid and pressure leakage) can occur due to various factors. When such leakage occurs, a cement job is often performed to seal leaks in the annulus or between the casings within the well. One objective of this cementing operation is to achieve zonal isolation to prevent downhole fluids from migrating to the surface behind the casing strings (e.g., surface within the annulus, surface between the casings). This zonal isolation, again, is associated with the well integrity and is critical to the safe operation of the well. When the sealability of the cement is compromised, or downhole fluids migrate to the surface behind the casing strings, the well's integrity may be jeopardized.

In such incidents where the sealability of the cement is compromised or downhole fluids migrate to the surface behind the casing strings, sustained casing pressure (SCP) can be observed. The SCP can occur when pressure builds up behind the casing and continues to increase, even after it is bled off, leading to potential well control issues.

Figure 2:
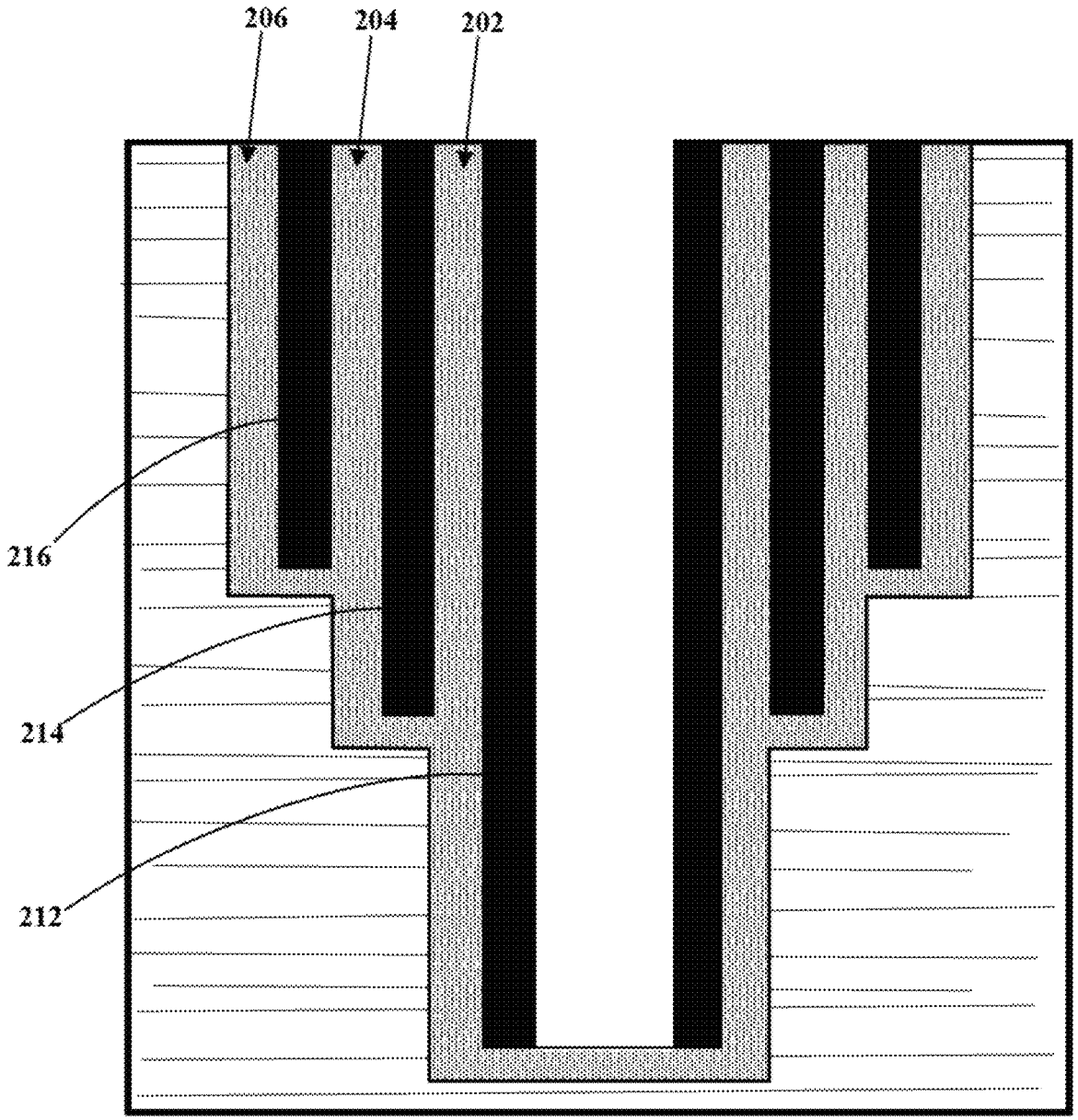
FIG. 2 is a diagram illustrating an example of multiple casings within a well.

The SCP is often associated with leaks that allow fluid migration and pressure buildup behind casing strings. These leaks, referred to as SCP-related leaks (or SCP leaks), can vary in type and complexity associated with remedial work based on the casing configuration and the depth of occurrence. For instance, as illustrated in FIG. 2, SCP leaks may manifest in specific locations depending on the pressure buildup behind different casing strings. Examples can include:

- CCA-1 pressure leaks at location 202: Pressure behind the innermost casing string 212 (e.g., casing with a 9-⅝" outer diameter);
- CCA-2 pressure leaks at location 204: Pressure behind the second innermost casing 214 (e.g., casing with a 13-⅜" outer diameter); and
- CCA-3 pressure leaks at location 206 and beyond: Pressure behind the third casing string 216 or further casing strings (e.g., casing with a 18-⅝" outer diameter).

Remediation methods often involve workover techniques such as installing a perforation gun, creating openings in the casing, and pumping sealants into the openings. However, traditional sealant materials, such as cement alone, may not provide reliable sealing due to issues such as inadequate injectivity, susceptibility to high-pressure and temperature variations, and the formation of channels or annulus that compromise the seal's long-term integrity.

In some implementations, remediation method involve deploying a single metal alloy into the well annulus to form a seal. While this remediation method can provide a metal-to-metal seal, it has some limitations. Single alloys may exhibit creep under high-pressure conditions, leading to compromised sealing over time.

Implementations in accordance with this disclosure relate to methods for sealing leaks in oil and gas wells, particularly those occurring in the annulus between casing strings, which can address the issues described above.

Implementations in accordance with this disclosure focuses on enhancing sealability and addressing the issues described above by using a multi-stage deployment system using a combination of metal alloy and cement to ensure effective sealing and confinement. In particular, combined use of metal alloy and cement offers a reliable sealing solution, reducing the risk associated with leaks (including pressure and fluid leaks), high-pressure and temperature variations, formation of channels or micro-annuli, creep under high-pressure conditions, etc., while maintaining the ability to access the wellbore for further operations.

Referring to FIGS. 3A-3F, diagrams illustrate an example of a method for sealing leak(s) in oil and gas wells using a combination of metal alloys and cement.

In particular, the steps for the method can include [1] accessing an annulus 302 (e.g., between two casing strings 304 and 306) associated with an area of fluid leakage within a wellbore, [2] deploying a first metal alloy 308 into a first portion 310 associated with the annulus 302 such that the first metal alloy 308 acts as an initial sealant, [3] performing a cement job (e.g., by deploying cement 312) to a second portion 314 associated with the annulus 302 and over the first metal alloy 308 (e.g., to thereby provide structural confinement and support to the first metal alloy 308), [4] deploying a second metal alloy 316 into a third portion 318 associated with the annulus 302 and over the cement 312, and [5] once the deployments are complete, removing a portion of solidified first metal alloy 308, solidified cement 312, and solidified second metal alloy 316 within an inner casing of the wellbore to thereby allow fluid communication between the wellbore and outside the wellbore.

Figures 3A, 3B, 3C, 3D, 3E, 3F:
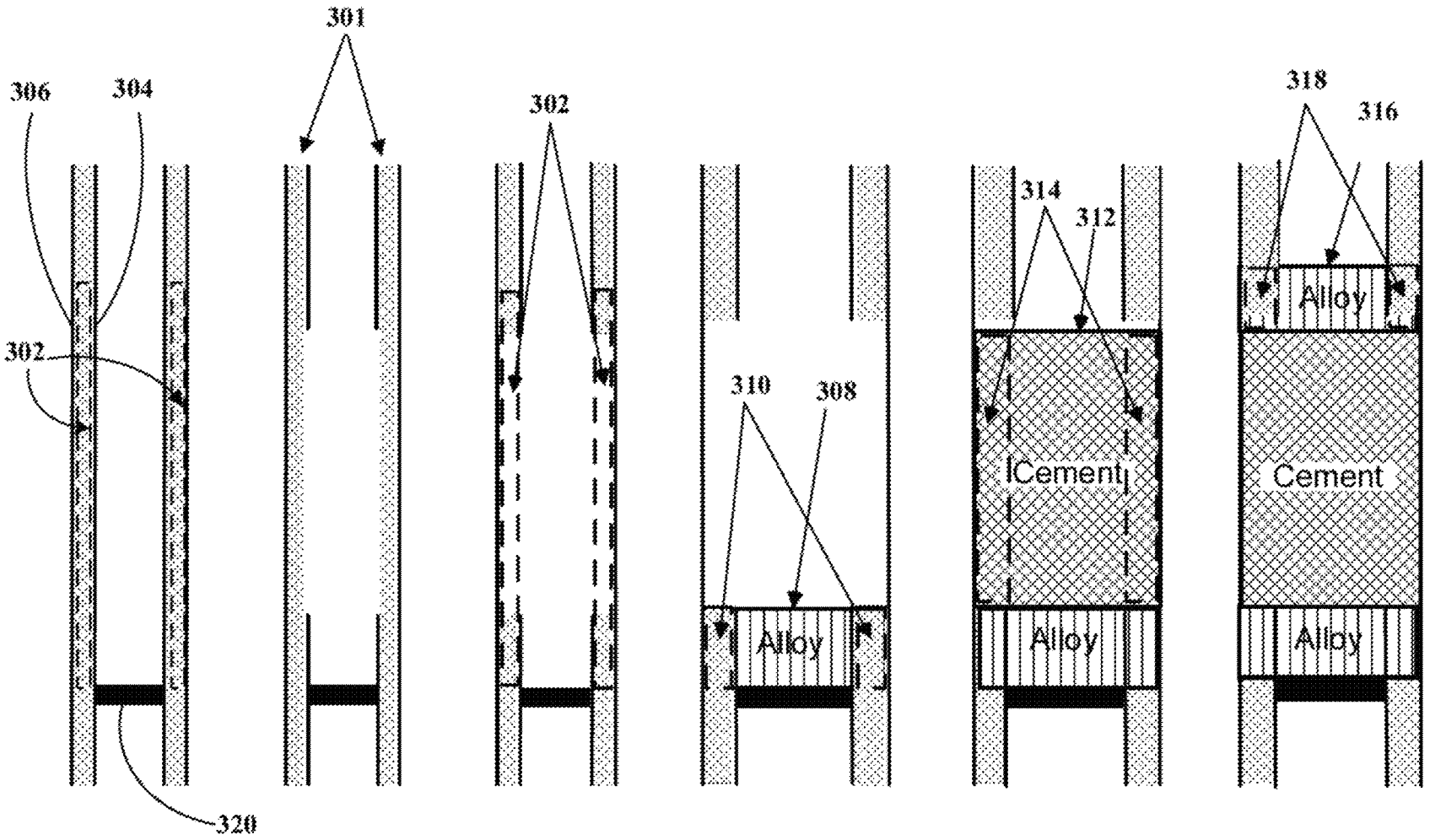
FIGS. 3A-3F are diagrams illustrating an example of a method for sealing leaks in oil and gas wells.

As an initial matter, FIG. 3A illustrates an example of an oil or gas well with a plug 320 inserted therein (within the wellbore or the well) prior to milling. The plug 320 can be disposed within an inner casing 301 of the wellbore or the well and isolate a section associated with the annulus within the wellbore. In some implementations, the plug 320 can be a mechanical plug (e.g., bridge plug) or a cement plug that is intentionally placed in the well to isolate sections for testing, assess leaks, conduct milling operation, prevent of external debris from falling down or entering the wellbore during the milling operation, prevent the potential migration of fluids within the wellbore, or for other purposes.

In operation, as an initial step, as illustrated in FIGS. 3B and 3C, the annulus 302 associated with an area of fluid leakage within the wellbore can be accessed. First, as illustrated in FIG. 3B, an inner casing string of the inner casing can be milled (e.g.., through section milling) or drilled to access the leaking area or the annulus. Thereafter, as illustrated in FIG. 3C, underreaming can be used to remove old cement and clean (e.g., scrape) the outer casing.

Figure 4C:
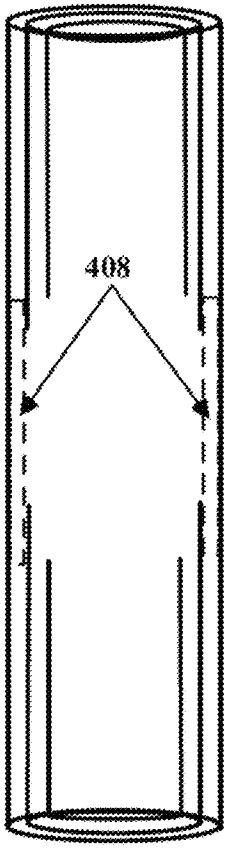
FIGS. 4A-4C are diagrams illustrating an example of gaining access to leakage location in oil and gas wells.
Figure 4B:
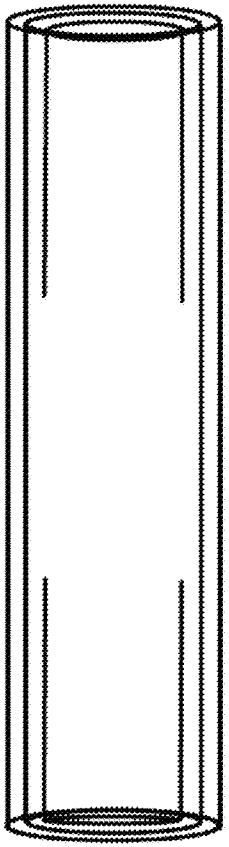
Figure 4A:
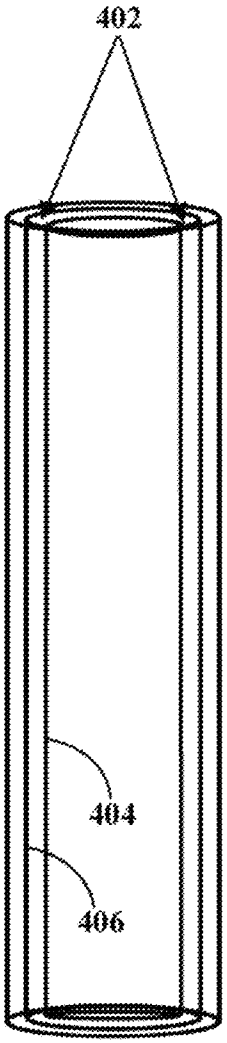

Before discussing the next step illustrated in FIG. 3D, FIGS. 4A-4C are diagrams illustrating an example of gaining access to leakage location in oil and gas wells. For example, FIG. 4A can be an example relating to descriptions of FIG. 3A, and FIGS. 4B and 4C can be examples relating to descriptions of FIGS. 3B and 3C. Specifically, FIG. 4A illustrates an example of an oil or gas well prior to milling. Although a plug (e.g., the plug 3) is not illustrated in the FIGS. 4A-4C, the plug (e.g., the plug 320) can be installed, for instance, at the inner casing 402 depicted in the FIGS. 4A-4C. Moreover, FIG. 4B illustrates that an innermost casing 404 string having 9-⅝" outer diameter has been milled and that cement between the innermost casing string 404 (having 9-⅝" outer diameter) and a second most inner casing string 406 (having 13-⅜" outer diameter) has been scraped. FIG. 4C illustrates that the second most inner casing string 406 (having 13-⅜" outer diameter) has been milled to access the annulus 408.

Next, as illustrated in FIG. 3D, a first metal alloy 308 can be deployed into the first portion 310 (e.g., lower portion) associated with the annulus 302. For example, a downhole tool can be used to dispose the first metal alloy 308 at the first portion 310.

In some implementations, deploying the first metal alloy 308 into the first portion 310 associated with the annulus 302 can be achieved using a free-fall mechanism or a solid-cast approach.

The free-fall method can include introducing small alloy beads into the inner casing 301, where their high density allows them to settle deeper until encountering an obstruction, such as the plug 320. For example, when the metal alloy beads encounter the plug 320, the plug 320 can act as a barrier and be the intended stopping point. In some implementations, a diameter of each of the metal alloy beads can be greater than or equal to 1 mm and less than or equal to 3 mm. Such diameter of the metal alloy beads can ensure that the metal alloy beads can enter or penetrate through the casing stumps at the first portion 310.

The solid-cast approach can employ the first metal alloy 308 cast in solid form around the downhole tool (such as a drill pipe or specialized tool). The cast material (e.g., the first metal alloy 308) can be configured with an inner diameter matching the downhole tool's outer diameter and an outer diameter slightly smaller than the drift diameter of the pre-set and milled casing. In some implementations, the first metal alloy 308 can be used to create an alloy ring or sleeve that fits around the downhole tool, where a diameter of the alloy ring or sleeve is smaller than a diameter of the inner casing string. The downhole tool can then be used to dispose the first metal alloy 308 at the first portion of the annulus.

In some implementations, the first metal alloy 308 or the metal alloy beads of the first metal alloy 308 can be squeezed into the first portion 310 within the annulus 302 using one or more packers (as the downhole tool) and pressure from above to increase the penetration of the first metal alloy 308 into the first portion 310 of the annulus 302 for sealing at higher wellbore pressures and to counter the effects of creep. For example, the packer can be used to [1] isolate a targeted section of the annulus 302, [2] dispose the first metal alloy 308 at the annulus 302, and/or [3] direct an applied pressure from the wellbore to the annulus 302 to thereby enhance penetration of the metal alloy 308 into the annulus. In some implementations, the first metal alloy 308 can be deployed or squeezed into the first portion 310 within the annulus 302 based on gravity in combination with or without the application of pressure.

In some implementations, the first metal alloy 308 can be selected based on its high sealing properties and resistance to corrosion. In some implementations, the first metal alloy 308 can include or correspond to a eutectic alloy. Use of the eutectic alloy, such as bismuth-based alloy, as of part of the first metal alloy 308, can enhance confinement due to following eutectic alloy's following advantageous properties: [1] unlike traditional metals or non-eutectic alloys, the eutectic alloy expands upon solidification like ice (which can advantageous in ensuring tight sealing); [2] when molten, the eutectic alloy has very low viscosity (which can be advantageous for infiltration and precise placement); [3] the eutectic alloy melts at relatively low temperatures compared to traditional metals like steel or non-eutectic alloys; [4] the eutectic alloy has high corrosion resistance; and [5] the eutectic alloy is not a biodegradable material.

In some implementations, the first metal alloy 308 can be selected based on [1] wellbore temperature and [2] melting point of one or more alloys. For instance, selecting the first metal alloy 308 can include [1] measuring the wellbore temperature or the temperature at the relevant portion (e.g., near the annulus) within the wellbore and [2] selecting one or more alloys with melting point that exceeds the measured temperature by a predetermined margin. In some implementations, one or more alloys can be blended in specific proportions, allowing a specific type of alloy to be combined with another type of alloy or bismuth-based alloy to achieve a target melting point that exceeds the measured temperature by a predetermined margin.

After the first metal alloy 308 is deployed into the first portion 310, the first metal alloy 308 can act as an initial sealant. For example, the first metal alloy 308 can form an initial seal within the annulus 302, space between the two casing strings 304 and 306, or space between the casing and the surrounding cement. This initial seal can seal off the first portion 310 or the lower portion of the annulus 302.

Next, as illustrated in FIG. 3E, the cement job is performed to the second portion 314 associated with the annulus 302 and over the first metal alloy 308. Performing the cement job to the second portion 314 and over the first metal alloy 308 can provide structural confinement and support to the first metal alloy 308. In some implementations, a method involving use of a stinger (e.g., a piece of open-ended drill pipe) can be used to perform the cement job to thereby dispose cement 312 to the second portion and over the first metal alloy 308. For example, the stinger can be lowered into the well and connected to a cement pump at the surface. The cement 312 can then be pumped through the stinger and be flown into the annulus 302. This cement job can ensure that the cement 312 fills the annulus (e.g., the second portion of the annulus) effectively in addition to or in combination with the first metal alloy 304, creating a solid barrier to stabilize and seal the casing and prevent fluid migration.

Next, as illustrated in FIG. 3F, a second metal alloy 316 can be deployed into a third portion 318 associated with the annulus 302 and over the cement layer 312. Since, the technique for deploying the second metal alloy 316 into the third portion 318 can be similar to the technique for deploying the first metal alloy 308 into the first portion 310, the technique will not be repeated here.

Once the deployments of the first metal alloy 308, the cement layer 312, and the second metal alloy 316 are complete, at least some portion of solidified first metal alloy layer 308, solidified cement layer 312 and solidified second metal alloy layer 316 within the inner casing 301 can be removed to thereby allow fluid communication between the wellbore (or the well) and outside the wellbore (or the well). For instance, the solidified layers can be removed from the inner casing 301, except for the solidified layers that filled the annulus 302, ensuring that the inner casing retains a shape similar to that shown in FIG. 3A.

In some implementations, specific volumes of the deployed first metal alloy 308 or the deployed second metal alloy 316 can depend on [1] a size of the casing 301 and [2] pressure that the metal alloy is required to withstand within or behind the casing 301.

In some implementations, specific volumes of the deployed first metal alloy 308 or the deployed second metal alloy 316 can depend on an anticipated length of the first metal alloy 308 or the second metal alloy 316, respectively, required to fill the first portion 310 or the third portion 318 to thereby withstand a certain degree of pressure. In some implementations, the anticipated length can be less than 5 feet to achieve a 5000 psi seal (e.g., for the bismuth-based alloy), and as such, the first metal alloy 308 or the length of the second metal alloy 316 that fill the first portion 310 or the third portion 318, respectively, can be less than 5 feet. In some implementations, volumes of the first metal alloy 308 or the second metal alloy 316 can be determined accordingly based on the anticipated length and a type of metal alloy (e.g., bismuth-based alloy, blended alloy mixture, high-temperature alloys, low-melting alloy, etc.) to withstand a certain degree of pressure (e.g., 5000 psi).

In some implementations, an area of fluid leakage may be only in the first portion 310 and the third portion 308, with the cement layer being deployed at the second portion 314 between the first portion 310 filled with the first metal alloy 308 and the third portion 318 filled with the second metal alloy 316. In such instances, the annulus associated with the area of fluid leakage can include the first portion 310, the second portion 314, and the third portion 308.

In some implementations, the first metal alloy 308 and the second metal alloy 316 (or metal alloy beads thereof) can be deployed to the first portion 310 and the third portion 318, respectively, in their liquid state, while applying heat to the first metal alloy 308 and the second metal alloy 316 (e.g., via a heater), respectively, to maintain the first metal alloy 308 and the second metal alloy 316 in their liquid state. Once the first metal alloy 308 is cooled for sufficient time, the cement 312 can be deployed over the first metal alloy 308. In some implementations, the duration of the cooling time can be determined based on the ambient temperature in the well, type of specific alloy used, melting/eutectic point of the specific alloy, or volume of the alloy.

In some implementations, the cement 312 can be deployed at a specific timing. For instance, the cement 312 can be deployed on the surface of the first metal alloy 308 while the center of the first metal alloy 308 is a liquid state or molten state and the outer radial portion of the first metal alloy 308 is solidified. For instance, the cement 312 can be deployed on the surface of the first metal alloy 308 while the first metal alloy 308 is in a liquid state at a predetermined distance (e.g., at a predetermined radial distance margin) from the center. This would be beneficial as this (e.g., the cement 312 filling at least some of the center portion) would act to confine the first metal alloy 308 alloy which can expand as it cools and solidifies. Such confinement can, for instance, restrict the axial expansion and increase the radial expansion and thus, potentially improve the seal.

In some implementations, the second metal alloy 316 can be deployed after the cement 312 is fully solidified and sufficiently hard to support the second metal alloy 316.

Figure 5:
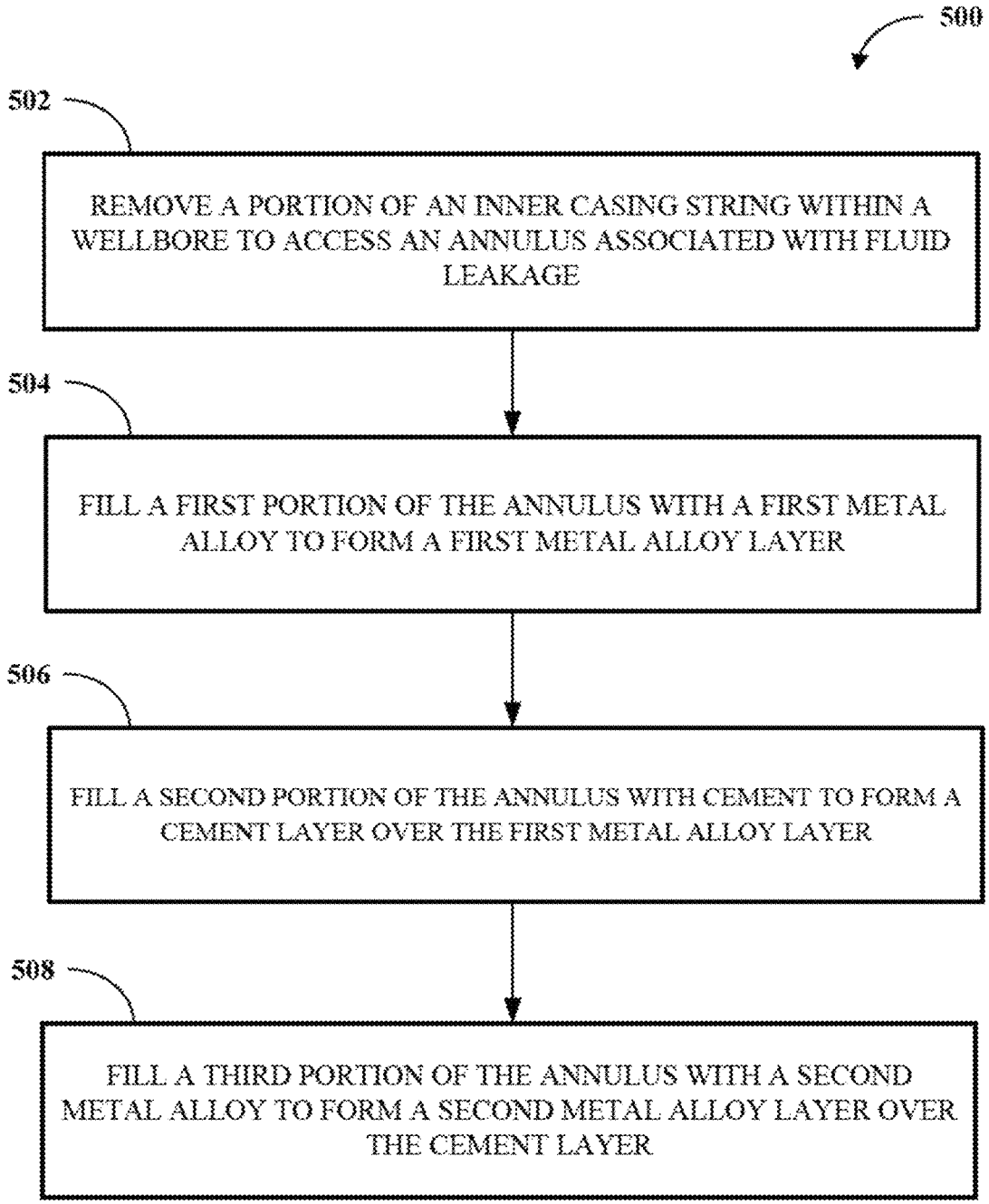
FIG. 5 is a flow chart diagram of an example process for sealing leaks in oil and gas wells.

FIG. 5 is a flow chart diagram 500 of an example process for sealing leaks in oil and gas wells. For example, the flow chart diagram 500 can be implement, be implemented by, or implemented in conjunction with, the processes and implementations described in FIGS. 3A-3F and FIGS. 4A-4C.

At 502, a portion of an inner casing string within a wellbore is removed to access an annulus associated with an area of fluid leakage. Removing the portion of an inner casing string can include performing section milling or drilling of the inner casing string. In some implementations, after removing the portion of the inner casing string, at least a portion of existing cement at the annulus can be scraped.

At 504, a first portion of the annulus is filled with a first metal alloy to form a first metal alloy layer. In some implementations, the first portion of the annulus can be associated with, or correspond to, a lower portion of the annulus.

In some implementations, filling the first portion of the annulus with the first metal alloy (or deploying the first metal alloy into the first portion of the annulus) can be achieved using a free-fall mechanism or a solid-cast approach, as described above with respect to the discussion of FIG. 3D.

For example, the free-fall method can include introducing small alloy beads into the inner casing (e.g., the inner casing 301), where their high density allows them to settle deeper until encountering an obstruction, such as a plug (e.g., the plug 320). For example, when the metal alloy beads encounter the plug, the plug can act as a barrier and be the intended stopping point. In some implementations, a diameter of each of the metal alloy beads is greater than or equal to 1 mm and less than or equal to 3 mm.

Moreover, for example, the solid-case approach can include the first metal alloy being cast in solid form around the downhole tool (in a form of a drill pipe or specialized tool), with an inner diameter matching the drill pipe's outer diameter and an outer diameter slightly smaller than the drift diameter of the pre-set and milled casing.

In some implementations, a metal alloy (that is to be used in the first metal alloy layer) can be used to create an alloy ring or sleeve that fits around a downhole tool, where a diameter of the alloy ring or sleeve is smaller than a diameter of the inner casing string, and applying the first metal alloy layer to the first portion of the annulus can include using such downhole tool to dispose the metal alloy at the annulus.

In some implementations, applying the first metal alloy layer to the first portion of the annulus includes (i) isolating a targeted section of the annulus using a packer, (ii) disposing a metal alloy at the annulus using the packer, and (iii) directing an applied pressure from a wellbore to the annulus, via the packer, to thereby enhance penetration of the metal alloy into the annulus.

In some implementations, the first metal alloy can include or correspond to a eutectic alloy. In some implementations, the first metal alloy can include or correspond to a bismuth-based alloy.

In some implementations, the first metal alloy can be selected based on [1] wellbore temperature and [2] melting point of one or more alloys. For instance, selecting the first metal alloy can include [1] measuring the wellbore temperature or the temperature of the relevant portion (e.g., near the annulus) within the wellbore and [2] selecting one or more alloys with melting point that exceeds the measured temperature by a predetermined margin. In some implementations, one or more alloys can be blended in specific proportions, allowing a certain type of alloy to be combined with another type of alloy or bismuth-based alloy to achieve a target melting point that exceeds the measured temperature by a predetermined margin.

In some implementations, filling the first portion of the annulus with the first metal alloy includes disposing metal alloy beads at a plug that is disposed within an inner casing of the wellbore and that isolates a section associated with the annulus within the wellbore. In some implementations, a diameter of each of the metal alloy beads is greater than or equal to 1 mm and less than or equal to 3 mm.

In some implementations, specific volumes of the deployed first metal alloy can depend on [1] a size of the casing and [2] pressure that the metal alloy is required to withstand within or behind the casing.

In some implementations, specific volumes of the deployed first metal alloy can depend on an anticipated length of the first metal alloy required to fill the first portion to thereby withstand a certain degree of pressure. In some implementations, the anticipated length of first portion can be less than 5 feet to achieve a 5000 psi seal (e.g., for the bismuth-based alloy), and as such, the first metal alloy that fills the first portion can be less than 5 feet. In such instances, volumes of the first metal alloy can be determined accordingly based on the length of the anticipated length of the first portion required and a type of metal alloy to withstand a certain degree of pressure.

In some implementations, the first metal alloy can be deployed to the first portion in its liquid state, while applying heat to the first metal alloy (e.g., via a heater) to maintain the first metal alloy in its liquid state. Once the first metal alloy is cooled for sufficient time, the cement can be deployed over the first metal alloy. In some implementations, the duration of the cooling time can be determined based on the ambient temperature in the well, type of specific alloy used, melting/eutectic point of the specific alloy, or volume of the alloy.

At 506, a second portion of the annulus is filled with cement (or the cement is applied over the first metal alloy) to form a cement layer over the first metal alloy layer. Filling the second portion with the cement (or applying the cement layer over the first metal alloy layer) can provide structural confinement and support to the first metal alloy layer. In some implementations, a stinger (e.g., a piece of open-ended drill pipe) can be used to perform the cement job to thereby dispose cement to the second portion and over the first metal alloy layer. For example, the stinger can be lowered into the well and be connected to a cement pump at the surface. The cement can then be pumped through the stinger and be flown into the annulus. This cement job can ensure that the cement fills the annulus (e.g., the second portion of the annulus) effectively in addition to or in combination with the first metal alloy, creating a solid barrier to stabilize the casing, seal off formations, and prevent fluid migration.

In some implementations, the cement can be deployed at a specific timing. For instance, the cement can be deployed on the surface of the first metal alloy while the center of the first metal alloy is a liquid state or molten state and the outer radial portion of the first metal alloy is solidified. For instance, cement can be deployed on the surface of (or at the center of) the first metal alloy while the first metal alloy is in a liquid state at a predetermined distance (e.g., at a predetermined radial distance margin) from the center.

At 508, a third portion of the annulus can be filled with a second metal alloy to form a second metal alloy layer over the cement layer. In some implementations, the technique for deploying the second metal alloy into the third portion can be similar to the technique for deploying the first metal alloy into the first portion.

In some implementations, filling the third portion of the annulus with the second metal alloy includes (i) disposing a metal alloy (that is to be used for the second metal alloy layer) over the cement layer using a packer and (ii) directing an applied pressure from a wellbore to the annulus, via the packer, to thereby enhance penetration of the metal alloy into the annulus.

In some implementations, the second metal alloy can include or correspond to a eutectic alloy. In some implementations, the second metal alloy can include or correspond to a bismuth-based alloy.

In some implementations, filling the third portion of the annulus with the second metal alloy includes disposing metal alloy beads at the cement disposed in the previous step. In some implementations, a diameter of each of the metal alloy beads is greater than or equal to 1 mm and less than or equal to 3 mm.

In some implementations, a metal alloy (that is to be used for the second metal alloy layer) can be used to create an alloy ring or sleeve that fits around a downhole tool in the same manner as described above with respect to implementations in step 504, where a diameter of the alloy ring or sleeve is smaller than a diameter of the inner casing string, and filling the third portion of the annulus with the second metal alloy can include using such downhole tool to dispose the metal alloy at the annulus.

Once the third portion of the annulus is filled with the second metal alloy, the first metal alloy layer, the cement layer, and the second metal alloy layer together can seal (or form a seal at) the annulus.

In some implementations, after the third portion of the annulus is filled with the second metal alloy, at least a portion of solidified first metal alloy layer, solidified cement layer, and solidified second metal alloy layer within an inner casing of the wellbore can be removed to thereby allow fluid communication between the wellbore and outside the wellbore.

Examples

In the implementations described above, with respect to FIGS. 3A-5, which employ the multi-stage deployment method using a combination of metal alloy and cement to seal an annulus associated with the fluid leakage, improvements in tolerating high-pressure differentials without pressure leakage were observed. Such improvements were observed compared to a reference case where only cement was used for sealing the annulus, which led to a pressure leakage under the similar testing conditions.

Figure 6:
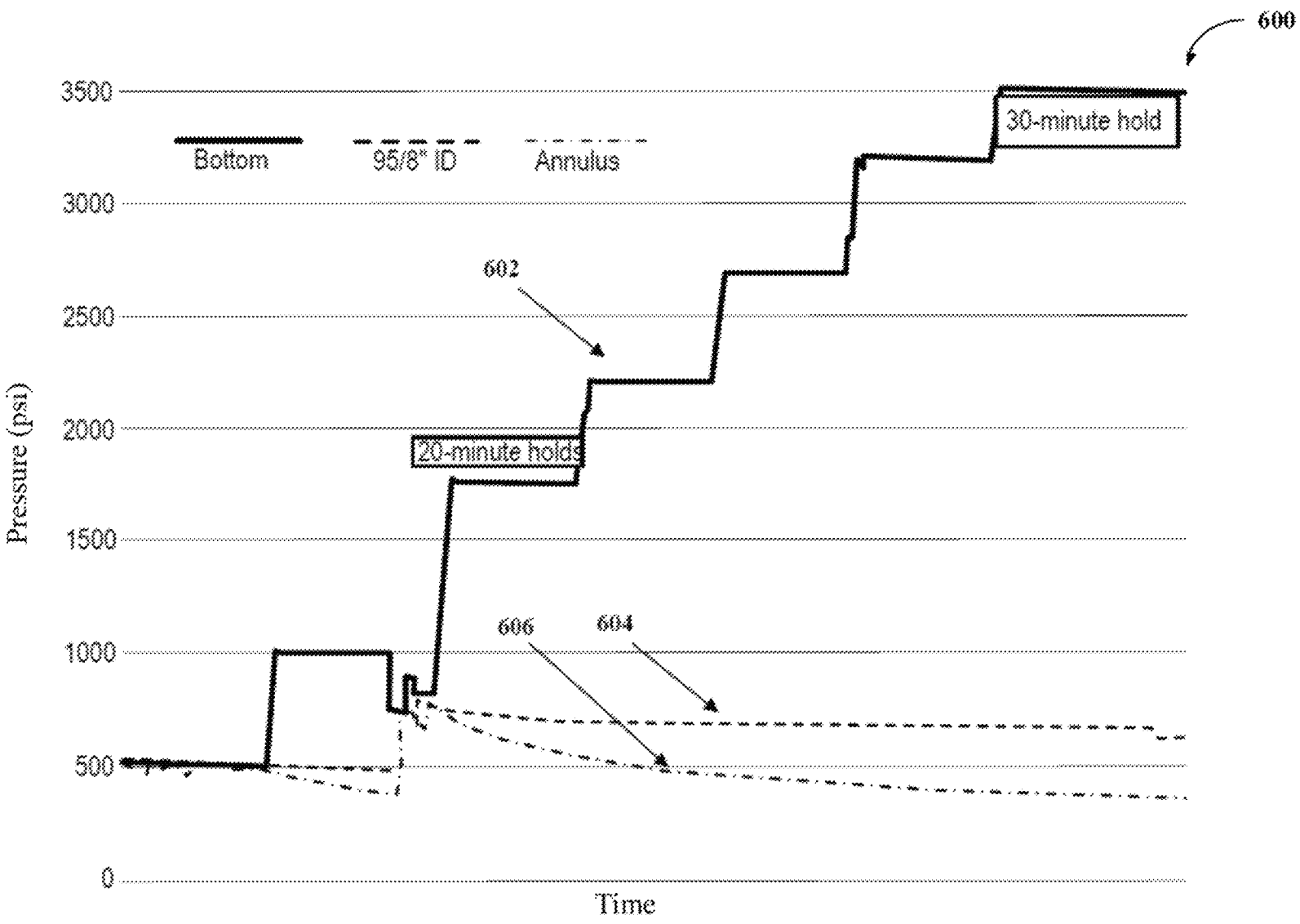
FIG. 6 is a graph of an example experiment illustrating the ability of a casing to withstand high-pressure differentials without pressure leakage.

For instance, FIG. 6 is a graph 600 of an example experiment illustrating the ability of a casing (with the annulus treated using the multi-stage deployment method for sealing leaks) to withstand high-pressure differentials without the pressure leakage.

Specifically, the experiment involved the testing a pressure of the annulus behind the casing string after the annulus (or the leakage location) has been treated with a combination of metal alloy layers with a cement layer therebetween, as described above with respect to the implementations regarding FIGS. 3A-5.

To test the pressure, pressure was applied on one side (the bottom) of the casing, and any pressure changes on the annulus were recorded. As shown in the graph 600, y-axis represents the recorded pressure and x-axis represents time. Specifically, pressure applied to the bottom, as shown by line 602, reached a maximum of 3500 psi with multiple 20-minute and 30-minute time holds in the interim. No pressure leak or bleed-off was observed on the annulus (illustrated by line 606) or the casing (illustrated by line 604) which has an outer diameter of 9⅝ inches.

Embodiments

According to one aspect of the subject matter described in this application, a method of sealing leaks in oil and gas wells includes: removing a portion of an inner casing string within a wellbore to access an annulus associated with an area of fluid leakage; filling a first portion of the annulus with a first metal alloy to form a first metal alloy layer; filling a second portion of the annulus with cement to form a cement layer over the first metal alloy layer; and filling a third portion of the annulus with a second metal alloy to form a second metal alloy layer over the cement layer. The first metal alloy layer, the cement layer, and the second metal alloy layer together seal the annulus.

Implementations according to this aspect can include one or more of the following features. For example, filling the first portion of the annulus with the first metal alloy can include disposing metal alloy beads at a plug that is disposed within an inner casing of the wellbore and that isolates a section associated with the annulus within the wellbore.

In some implementations, a diameter of each of the metal alloy beads is greater than or equal to 1 mm and less than or equal to 3 mm.

In some implementations, the method can further include using the first metal alloy to create an alloy ring or sleeve that fits around a downhole tool, where a diameter of the alloy ring or sleeve is less than a diameter of the inner casing string. Filling the first portion of the annulus with the first metal alloy can include using the downhole tool to dispose the first metal alloy at the annulus.

In some implementations, at least one of the first metal alloy or the second metal alloy can include a eutectic alloy.

In some implementations, at least one of the first metal alloy or the second metal alloy can include a bismuth-based alloy.

In some implementations, removing the portion of an inner casing string can include performing section milling or drilling of the inner casing string.

In some implementations, filling the first portion of the annulus with the first metal alloy can include: isolating a targeted section of the annulus using a packer; disposing the first metal alloy at the annulus using the packer; and directing an applied pressure from the wellbore to the annulus, via the packer, to thereby enhance penetration of the first metal alloy into the annulus.

In some implementations, filling the third portion of the annulus with the second metal alloy can include: disposing the second metal alloy over the cement layer using a packer; and directing an applied pressure from a wellbore to the annulus, via the packer, to thereby enhance penetration of the second metal alloy into the annulus.

In some implementations, the first portion of the annulus is filled with the first metal alloy, the second portion of the annulus is filed with the cement, and the third portion of the annulus is filled with the second metal alloy in consecutive steps.

In some implementations, the first portion corresponds to a lower portion of the annulus, the third portion corresponds to an upper portion of the annulus, and the second portion corresponds to a portion between the lower portion and the upper portion.

In some implementations, the method can further include, after removing the portion of the inner casing string and prior to filling the first portion of the annulus with the first metal alloy, scraping at least a portion of existing cement at the annulus.

In some implementations, the method can further include, after filling the third portion of the annulus with the second metal alloy, removing a portion of solidified first metal alloy layer, solidified cement layer, and solidified second metal alloy layer within an inner casing of the wellbore to thereby allow fluid communication between the wellbore and outside the wellbore.

According to another aspect of the subject matter described in this application, a method can include: applying a first metal alloy layer to a mechanical plug to fill a bottom portion of an annulus associated with an area of fluid leakage within a wellbore, where the mechanical plug is disposed within an inner casing of a wellbore and isolates a section associated with the annulus within the wellbore; applying a cement layer over the first metal alloy layer; and applying a second metal alloy layer to the cement layer, where at least the first metal alloy layer and the second metal alloy layer together seal the annulus.

Implementations according to this aspect can include one or more of the following features. For example, applying the first metal alloy layer to the mechanical plug can include disposing metal alloy beads at the mechanical plug.

In some implementations, a diameter of each of the metal alloy beads is greater than or equal to 1 mm and less than or equal to 3 mm.

In some implementations, at least one of the first metal alloy layer or the second metal alloy layer can include a eutectic alloy.

In some implementations, at least one of the first metal alloy layer or the second metal alloy layer can include a bismuth-based alloy.

In some implementations, the method can further include, after applying the second metal alloy layer to the cement layer, removing a portion of solidified first metal alloy layer, solidified cement layer, and solidified second metal alloy layer within an inner casing of the wellbore to thereby allow fluid communication between the wellbore and outside the wellbore.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A method of sealing leaks in oil and gas wells, the method comprising:

removing a portion of an inner casing string within a wellbore to access an annulus associated with an area of fluid leakage;

filling a first portion of the annulus with a first metal alloy to form a first metal alloy layer;

filling a second portion of the annulus with cement to form a cement layer over the first metal alloy layer; and filling a third portion of the annulus with a second metal alloy to form a second metal alloy layer over the cement layer, wherein the first metal alloy layer, the cement layer, and the second metal alloy layer together seal the annulus.

2. The method of claim 1, wherein filling the first portion of the annulus with the first metal alloy comprises:

disposing metal alloy beads at a plug that is disposed within an inner casing of the wellbore and that isolates a section associated with the annulus within the wellbore.

3. The method of claim 2, wherein a diameter of each of the metal alloy beads is greater than or equal to 1 mm and less than or equal to 3 mm.

4. The method of claim 1, further comprising:

using the first metal alloy to create an alloy ring or sleeve that fits around a downhole tool, wherein a diameter of the alloy ring or sleeve is less than a diameter of the inner casing string, and wherein filling the first portion of the annulus with the first metal alloy comprises using the downhole tool to dispose the first metal alloy at the annulus.

5. The method of claim 1, wherein at least one of the first metal alloy or the second metal alloy comprises a eutectic alloy.

6. The method of claim 1, wherein at least one of the first metal alloy or the second metal alloy comprises a bismuth-based alloy.

7. The method of claim 1, wherein removing the portion of an inner casing string comprises:

performing section milling or drilling of the inner casing string.

8. The method of claim 1, wherein filling the first portion of the annulus with the first metal alloy comprises:

isolating a targeted section of the annulus using a packer;

disposing the first metal alloy at the annulus using the packer; and directing an applied pressure from the wellbore to the annulus, via the packer, to thereby enhance penetration of the first metal alloy into the annulus.

9. The method of claim 1, wherein filling the third portion of the annulus with the second metal alloy comprises:

disposing the second metal alloy over the cement layer using a packer; and directing an applied pressure from a wellbore to the annulus, via the packer, to thereby enhance penetration of the second metal alloy into the annulus.

10. The method of claim 1, wherein the first portion of the annulus is filled with the first metal alloy, the second portion of the annulus is filed with the cement, and the third portion of the annulus is filled with the second metal alloy in consecutive steps.

11. The method of claim 10, wherein the first portion corresponds to a lower portion of the annulus, the third portion corresponds to an upper portion of the annulus, and the second portion corresponds to a portion between the lower portion and the upper portion.

12. The method of claim 10, further comprising:

after removing the portion of the inner casing string and prior to filling the first portion of the annulus with the first metal alloy, scraping at least a portion of existing cement at the annulus.

13. The method of claim 10, further comprising:

after filling the third portion of the annulus with the second metal alloy, removing a portion of solidified first metal alloy layer, solidified cement layer, and solidified second metal alloy layer within an inner casing of the wellbore to thereby allow fluid communication between the wellbore and outside the wellbore.

14. A method comprising:

applying a first metal alloy layer to a mechanical plug to fill a bottom portion of an annulus associated with an area of fluid leakage within a wellbore, wherein the mechanical plug is disposed within an inner casing of a wellbore and isolates a section associated with the annulus within the wellbore;

applying a cement layer over the first metal alloy layer; and applying a second metal alloy layer to the cement layer, wherein at least the first metal alloy layer and the second metal alloy layer together seal the annulus.

15. The method of claim 14, wherein applying the first metal alloy layer to the mechanical plug comprises:

disposing metal alloy beads at the mechanical plug.

16. The method of claim 15, wherein a diameter of each of the metal alloy beads is greater than or equal to 1 mm and less than or equal to 3 mm.

17. The method of claim 14, wherein at least one of the first metal alloy layer or the second metal alloy layer comprises a eutectic alloy.

18. The method of claim 14, wherein at least one of the first metal alloy layer or the second metal alloy layer comprises a bismuth-based alloy.

19. The method of claim 14, further comprising:

using a metal alloy to create an alloy ring or sleeve that fits around a downhole tool, wherein a diameter of the alloy ring or sleeve is less than a diameter of an inner casing of the wellbore associated with the annulus, wherein applying the first metal alloy layer to the mechanical plug comprises using the downhole tool to dispose the metal alloy at the mechanical plug.

20. The method of claim 14, further comprising:

after applying the second metal alloy layer to the cement layer, removing a portion of solidified first metal alloy layer, solidified cement layer, and solidified second metal alloy layer within an inner casing of the wellbore to thereby allow fluid communication between the wellbore and outside the wellbore.

* * * * *